United States Patent [19]

Valiyee et al.

[11] Patent Number: 4,986,449

[45] Date of Patent: Jan. 22, 1991

[54] BEVERAGE DISPENSING APPARATUS

[75] Inventors: Mojtaba Valiyee, Moraga; William A. Martindale; Richard A. Martindale, both of Vacaville, all of Calif.

[73] Assignee: Automatic Bar Controls, Inc., Vacaville, Calif.

[21] Appl. No.: 231,753

[22] Filed: Aug. 12, 1988

[51] Int. Cl.[5] ..... B67D 5/60

[52] U.S. Cl. ..... 222/144.5; 222/485; 137/606

[58] Field of Search ..... 222/129, 129.1, 129.3, 222/129.4, 144.5, 135, 136, 482, 484, 485; 137/884, 605, 606, 607

[56] References Cited

U.S. PATENT DOCUMENTS 4,497,421 2/1985 Schilling ..... 222/144.5
4,619,378 10/1986 Man ..... 222/144.5

FOREIGN PATENT DOCUMENTS 1300072 12/1969 United Kingdom ..... 137/884

*Primary Examiner*—H. Grant Skaggs

*Assistant Examiner*—Kenneth Noland

*Attorney, Agent, or Firm*—Townsend and Townsend

[57] ABSTRACT

A beverage dispensing apparatus includes a beverage dispensing head wherein a rigid plate is disposed over a mixing fluid valve stem and a plurality of base fluid valve stems. The plate has an opening located over each base fluid valve stem for receiving the associated base fluid valve stem therethrough. The plate has a rigid surface disposed over the mixing fluid valve stem. A mixing fluid button contacts the rigid surface of the plate so that, when the mixing fluid button is depressed, only the mixing fluid is dispensed. A first base fluid button covers the opening in the plate disposed over its associated base fluid valve stem. The first base fluid button also contacts the plate so that, when the button is depressed, the button depresses both the base fluid valve stem and the plate. The plate, in turn, depresses the mixing fluid valve stem. A second base fluid button includes a projection which extends through the opening in the plate without contacting the plate for depressing only its associated base fluid valve stem.

32 Claims, 7 Drawing Sheets

BEVERAGE DISPENSING APPARATUS

BACKGROUND OF THE INVENTION

1. Field Of The Invention

This invention relates to a beverage dispensing apparatus and, more particularly, to a beverage dispensing apparatus of the type in which several different beverages are dispensed from a single beverage dispensing head by pressing an appropriate button.

2. Description Of The Relevant Art

Hand-held beverage dispensers which provide the operator with the ability to dispense a number of different beverages by merely pressing an appropriate button have become quite popular. An example of such a beverage dispensing apparatus is shown in U.S. Pat. No. 3,863,810 to Hanson, which discloses the use of dual-valve valve stems connected to each button. One of the valve elements controls fluid flow through a soda channel, and the other valve element controls the flow of fluid through a syrup channel. Each button operates the two valves to control the passage of soda and syrup from the pressurized beverage component source to the nozzle. Because of the numerous syrup and soda passageways required, the number of beverages which may be accommodated in a chosen size dispensing head is limited.

One attempt to provide a system wherein a single soda or water valve is associated with and serves a plurality of syrup valves is disclosed in U.S. Pat. No. 4,497,421 to Schilling. In that device, the several syrup valves are arranged in a satellite array about the single common soda or water valve, and a bridging mechanism extends from each of the syrup valves to the soda or water valve so that manual operation of a syrup valve automatically results in operation of the soda or water valve. In addition, the soda or water valve may be independently operated, i.e., operated separately from any of the syrup valves, so that soda or water may be dispensed without syrup. One disadvantage of this device is that the number of syrup valves which may be coupled to the soda valve is limited by the number of buttons that can be arranged in a satellite array.

Another attempt to provide a system wherein a single soda or water valve is associated with and serves a plurality of syrup valves is disclosed in U.S. Pat. No. 4,619,378 to DeMan. In that device, a plate is rigidly mounted to the soda valve stem and extends over a plurality of syrup valve stems. The plate has an aperture disposed over each syrup valve stem, and a button is associated with each valve stem. Depressing any syrup button also depresses the soda valve stem, and both syrup and soda valves open. On the other hand pressing the soda button opens only the soda valve. For controlling the flow of beverages which are not mixed with soda, the plate includes cutout portions sized so that, when a button associated with a cutout portion is depressed, the button does not contact the plate. Therefore, only the beverage associated with that button is delivered from the dispensing unit.

Conventional beverage dispensing units typically have mixing problems which result from unequal opening response characteristics of the valves due to flexing of the bridging mechanism. The end result is that the proper proportion of syrup and soda is not mixed, and the drink does not taste right.

In all beverage dispensers of this type, the proportion of soda to syrup must be controlled for each beverage.

This is commonly done through the use of one or more brixing devices. Brixing devices typically use a valve for each syrup, similar to a gate valve, in which two intersecting cylinders are used to control the flow of syrup through the valve. Brixing devices typically are one-piece units wherein a plurality of such valves are formed within a housing. Because of the one-piece design, a new brixing device must be purchased whenever syrups are added or deleted. Consequently, the ability to freely modify the number of beverages dispensed becomes cost-prohibitive. Finally, brixing devices typically couple the beverage dispensing head to the beverage sources with screws. This makes servicing very difficult in a bar environment.

SUMMARY OF THE INVENTION

The present invention is directed to a beverage dispensing apparatus wherein a single mixing fluid valve is associated with and serves a plurality of base fluid valves in the beverage dispensing head. The number of base fluid valves associated with the single mixing fluid valve is not limited by the proximity of the base fluid valves to the mixing fluid valve, and the proper proportion of base and mixing fluids is maintained as they are dispensed. The invention also allows a base fluid valve to be operated independently of its associated mixing fluid valve so that syrup or some other beverage, such as orange juice or wine, may be dispensed alone. The apparatus according to the present invention also is constructed so that switchability of various base and mixing fluid combinations may be accomplished very quickly by using a kit having a minimum number of parts.

In one embodiment of a beverage dispensing head according to the present invention, a rigid plate is disposed over a mixing fluid valve stem and a plurality of base fluid valve stems. The plate has an opening located over each base fluid valve stem for receiving the associated base fluid valve stem therethrough. The plate has a rigid surface disposed over the mixing fluid valve stem. A mixing fluid button contacts the rigid surface of the plate so that, when the mixing fluid button is depressed, only the mixing fluid is dispensed. Whether a base fluid is dispensed alone or in combination with the mixing fluid depends upon the use of a button having one of two possible configurations. In the first configuration, the base fluid button covers the opening in the plate disposed over its associated base fluid valve stem. The base fluid button also contacts the plate so that, when the button is depressed, it depresses both the base fluid valve stem and the plate. The plate, in turn, depresses the mixing fluid valve stem. The other type of base fluid button configuration includes a projection which extends through the opening in the plate without contacting the plate. Thus, this type of base fluid button depresses only its associated base fluid valve stem.

The plate is pivotally mounted on an abutment, and the valve stems are located parallel to the abutment so that flexing of the plate is minimized when a base fluid button located far from the mixing fluid button is depressed. This ensures that the base and mixing fluid valves open simultaneously.

The kit for switching the base and/or mixing fluid combinations comprises a plurality of plates, each of which associates a plurality of base fluid valve stems with a mixing fluid valve stem, together with a plurality of buttons having both the first and second configurations. Since dispensing of a base fluid alone is accomplished by using a button having an extension which projects through the opening in the plate, special plates need not be constructed for this purpose. Thus, a single plate may be used with multiple base and/or mixing fluid combinations.

The invention also includes a brixing device wherein the beverage dispensing head may be decoupled from the source of base and mixing fluids quickly and without the use of tools. The brixing device according to the present invention is completely modular, and therefore allows mixing and base fluids to be added or deleted as desired without having to purchase another brixing device.

In one embodiment of the brixing device according to the present invention, a first housing has a plurality of first tubes attached thereto and having first ends extending therefrom. Each first tube has a recess disposed on a side of its first end. A second housing has a plurality of second tubes attached thereto, a first end of each second tube being sized for slideably receiving the first end of an associated first tube therein. The first end of each second tube has an opening which aligns with the recess in its associated first tube when the first and second tubes are matingly engaged. A portion of a fastening clip extends through the opening in a second tube and into the recess in the first tube to lock the first and second housings together. To facilitate decoupling of the first and second housings, a cam is pivotably disposed on one of the first or second housings for pressing the other housing away when the cam is pivoted.

Figure 3:
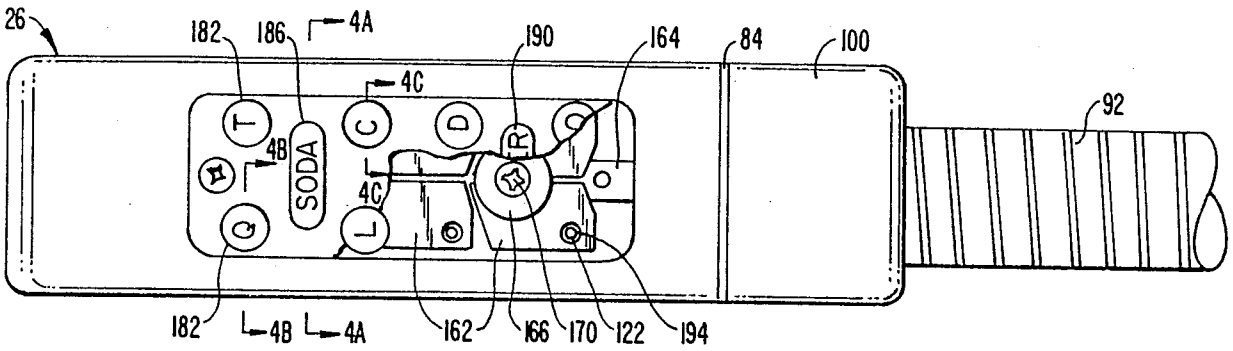
FIG. 3 is a top plan, partially cross-sectional view of the beverage dispensing head of FIG. 1.

FIGS. *4a–4c* are cross-sectional views taken along lines *4a–4a*, *4b–4b*, and *4c–4c*, respectively, of FIG. 3.

Figure 2:
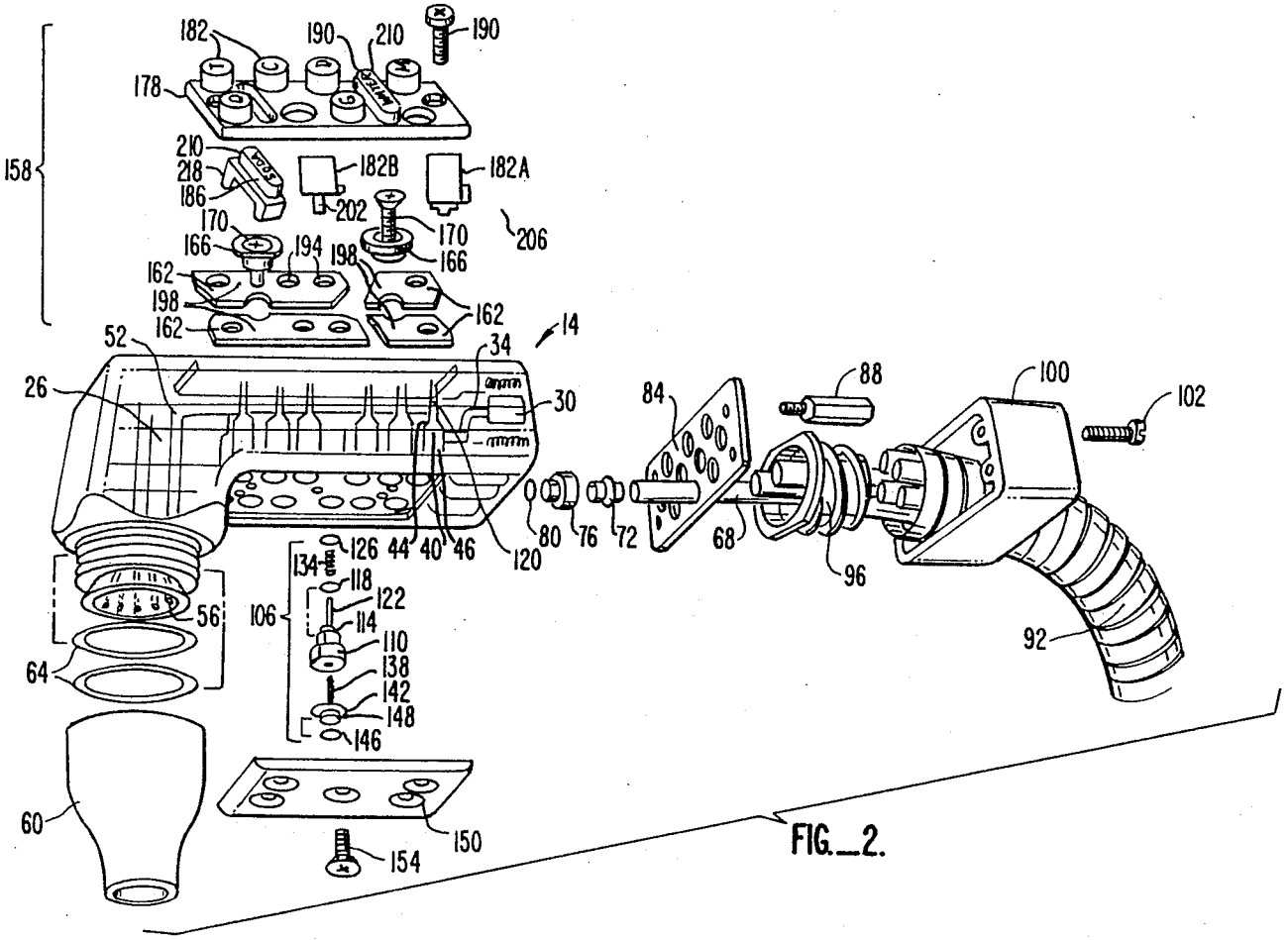
FIG. 2 is an exploded view of the beverage dispensing head of FIG. 1.
Figure 5:
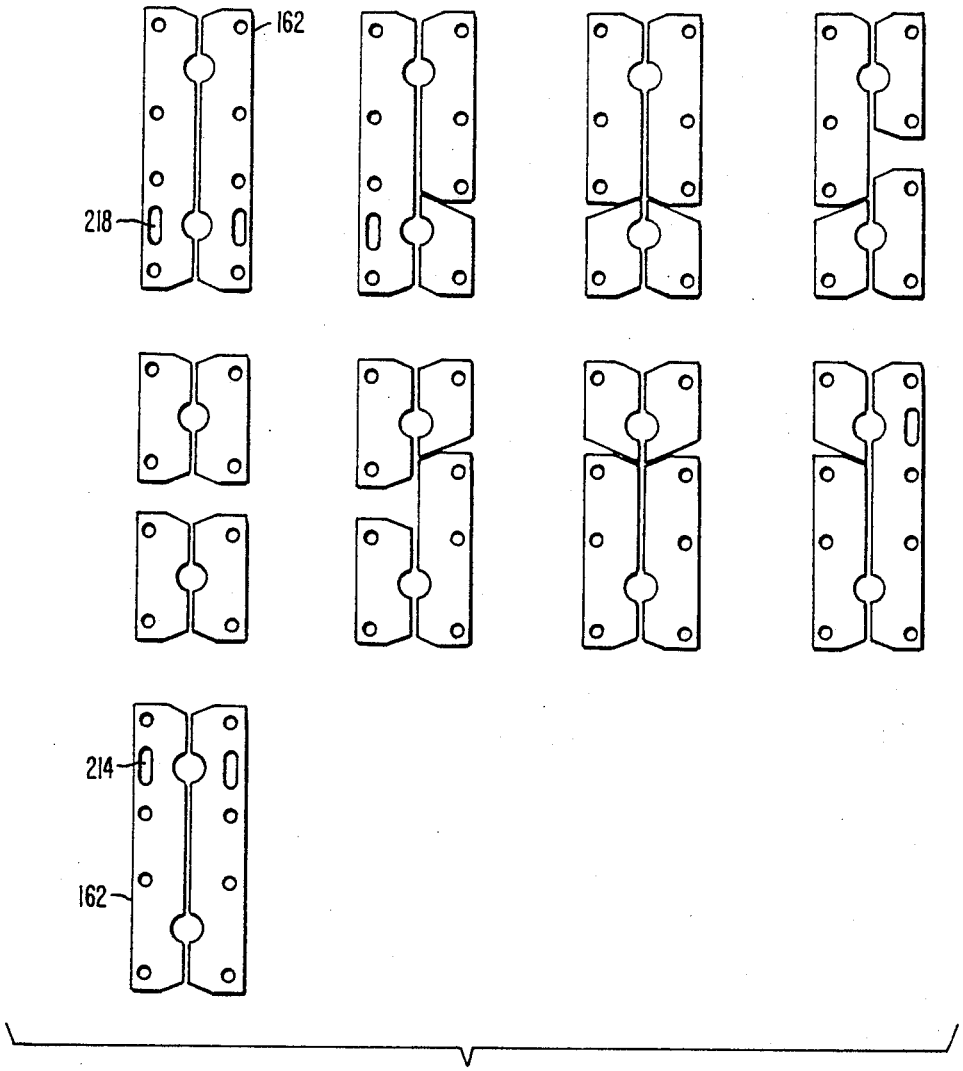

FIG. 5 is a diagram showing different combinations of butterfly valve plates which may be used with the beverage dispensing head of FIG. 2.

Figure 1:
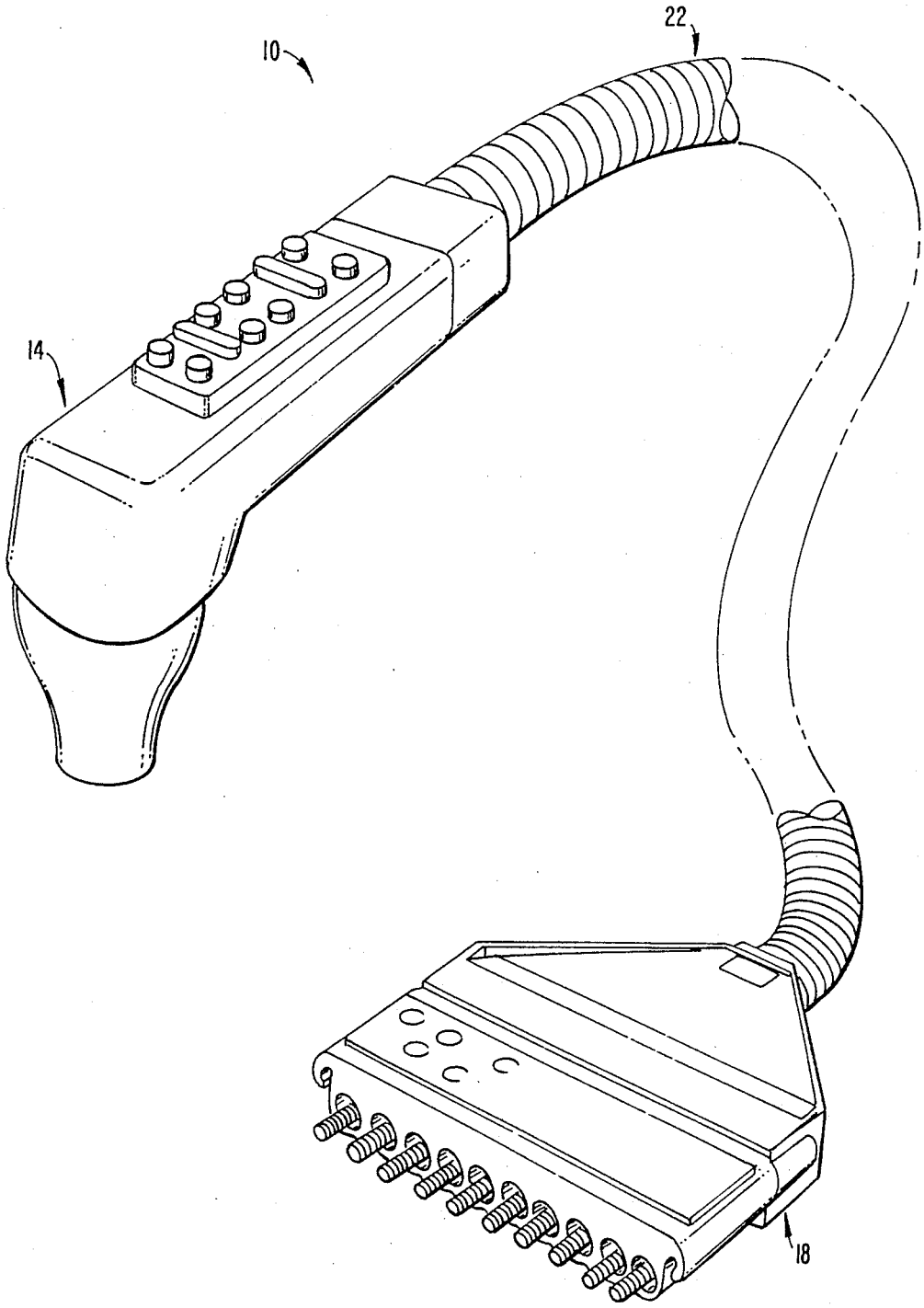
FIG. 1 is an overall perspective view of the beverage dispensing apparatus of the present invention.
Figure 6:
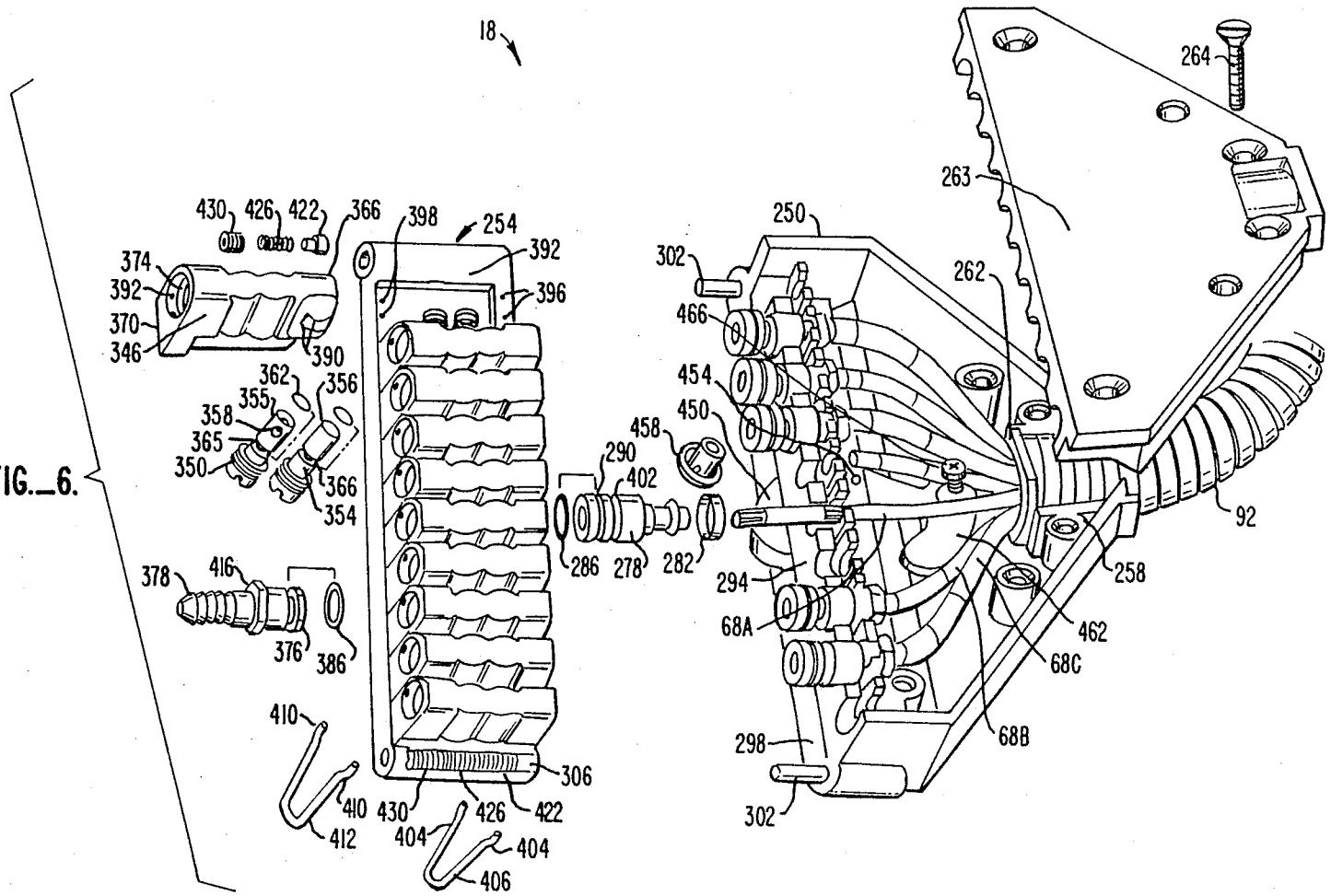

FIG. 6 is a partially exploded view of the brixing device of FIG. 1.

Figure 7:
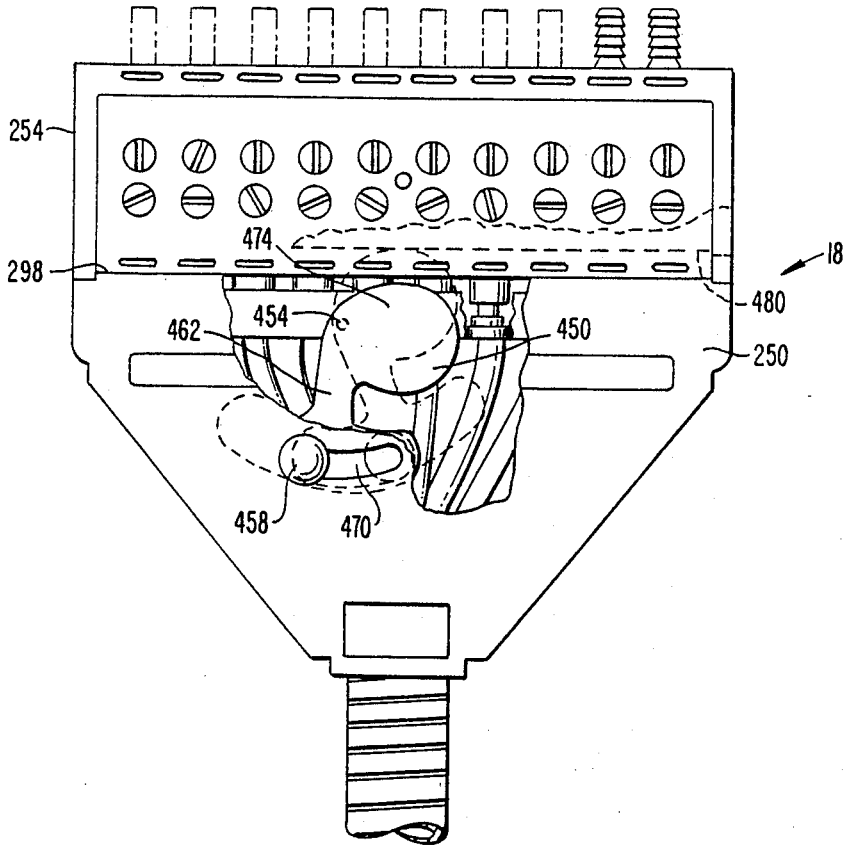

FIG. 7 is a bottom view of the brixing device of FIG. 1.

Figure 8:
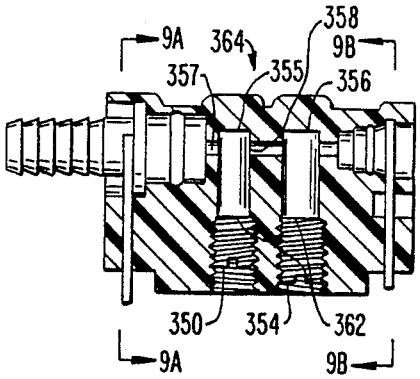

FIG. 8 is a side cross-sectional view of a fluid input module coupled with an associated interconnect fitting.

FIGS. *9a* and *9b* are cross-sectional views taken along lines *9a–9a* and *9b–9b*, respectively, of FIG. 8.

DETAILED DESCRIPTION OF THE PREFERRED EMBODIMENTS

FIG. 1 is an overall perspective view of the beverage dispensing apparatus 10 according to the present invention. Beverage dispensing apparatus 10 includes a beverage dispensing head 14 and a brixing device 18 coupled by a flexible line 22. Brixing device 18 is connected to a beverage component source (not shown) which supplies the brixing device with base fluids and mixing fluids at elevated pressures. Examples of base fluids are flavoring syrups, orange juice, wine, and liquor. Examples of mixing fluids are water and soda. Mixing fluids typically are combined with one or more base fluids, although, in some circumstances, they may be dispensed by themselves.

Beverage Dispensing Head

FIG. 2 is an exploded view of beverage dispensing head 14. Beverage dispensing head 14 comprises a handle 26 which, in this embodiment, is formed of a transparent acrylic material. Handle 26 includes a plurality of fluid passageways for dispensing the fluids received from the pressurized beverage source. For convenience and clarity, only one such passageway shall be described in detail. Each fluid passageway comprises a fluid entry opening 30 which is fluidly coupled to a fluid entry conduit 34. Fluid entry conduit 34 is, in turn, fluidly coupled to a valve bore 40. Valve bore 40 includes an annular shoulder forming a valve seat 44. The portion of valve bore 40 below valve seat 44 comprises a fluid entry chamber 46 which is fluidly coupled to fluid entry conduit 34. The portion of valve bore 40 above valve seat 44 comprises a fluid exit chamber 48 which is fluidly coupled to a fluid exit conduit 52. Fluid flows through fluid exit conduit 52 and out of handle 26 through a fluid exit opening 56 and a nozzle 60. Nozzle 60 is frictionally attached to handle 26 by O-rings 64.

Each fluid entry opening 30 is coupled to one of a plurality of fluid tubes 68 through a tube ferrule 72, tube ferrule cap 76, and tube seal O-ring 80. The tube ferrules 72 are maintained in place on handle 26 by a tube retainer plate 84, which is affixed to handle 26 by threaded retainer posts 88. As noted in FIG. 1, the plurality of tubes 68 are encased within a metal sheath 92. Sheath 92 terminates with a sheath bushing 96, and sheath bushing 96 is affixed to handle 26 by a handle heel cap 100 and machine screws 102.

For controlling the flow of fluid through each passageway, each valve bore 40 has fitted reciprocatingly therein a valve assembly 106. Each valve assembly 106 comprises a valve plunger 110 having an annular shoulder 114. Fitted on annular shoulder 114 is an O-ring 118. When disposed within valve bore 40, valve plunger ordinarily is in an upper, retracted position, and O-ring 118 presses against valve seat 44 for preventing fluid flow from fluid entry chamber 46 to fluid exit chamber 48 (see FIG. *4a*). On the other hand, when valve plunger 110 is disposed in a lower, extended position and O-ring 118 is spaced apart from valve seat 44, fluid is allowed to flow from fluid entry chamber 46 to fluid exit chamber 48, and thereafter through fluid exit conduit 52, fluid exit opening 56, and nozzle 60. A stem 122 of valve plunger 110 passes through an O-ring 126, which, in turn, seats against an annular shoulder 130 of valve bore 40 for preventing fluid flowing through fluid exit chamber 48 from leaking out of handle 26.

An upper valve spring 134 is disposed between O-ring 126 and O-ring 118. Upper valve spring 134 is affixed to O-ring 126 and stem 122 to help bias valve plunger 110 in an upper, or closed, position. Valve assembly 106 also includes a lower valve spring 138 and a spring hat 142 disposed beneath valve plunger 110. Lower valve spring 138 also helps to bias valve plunger 110 in an upper position. To prevent fluid flowing through fluid entry chamber 36 from leaking out of handle 26, a hat O-ring 146 is disposed on an annular shoulder 148 of spring hat 142 and sealingly engages valve bore 40. To maintain valve assembly 106 in place, a bottom plate 150 is secured to handle 26 by machine screws 154.

FIGS. 2, 3, and *4a–4c* illustrate the valve actuator assembly 158 used for controlling the operation of the plurality of valve assemblies 106. Valve actuator assembly 158 includes a plurality of butterfly plates 162. Butterfly plates 162 are pivotally mounted on an abutment 164 on the top portion of handle 26 through butterfly retainers 166 and machine screws 170. To maintain butterfly plates 162 in place on abutment 164 while allowing the plates to pivot, each butterfly plate 162 includes a plurality of ball bearing projections 170 (FIGS. **4*b*–4*c*) which fit within corresponding cavities 174 in abutment 164. The ball bearing pivot points for the butterfly plates are quite small, thereby reducing friction and increasing leverage for an easier activation. Disposed over butterfly plates 162 is a button plate 178 which retains a plurality of base fluid buttons 182 and, in this embodiment, a pair of mixing fluid buttons 186 and 190. In this embodiment, mixing fluid buttons 186, 190 are used to dispense soda and water, respectively. Button plate 178 is affixed to handle 26 by machine screws 190**.

Each butterfly plate 162 has a plurality of openings 194 for receiving a valve stem 122 therethrough. Typically, each butterfly plate 162 has an aperture 194 over each valve stem 122 located below it, except for those valves which are used to dispense mixing fluids. For dispensing mixing fluids, each butterfly valve 162 has a rigid surface portion 198 disposed over each mixing fluid valve. In this embodiment, each mixing fluid is routed to two valve bores located on opposite sides of abutment 164, as shown in FIG. **4*a***, for reasons discussed below.

Figure 4C:
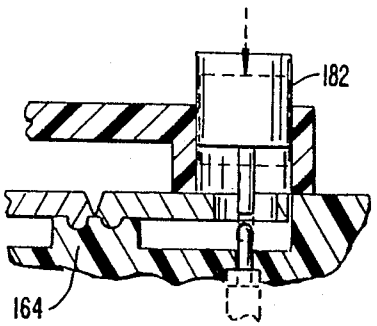
Figure 4B:
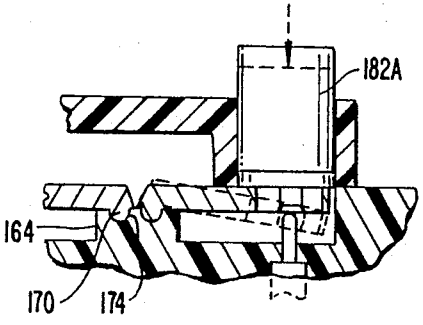
Figure 4A:
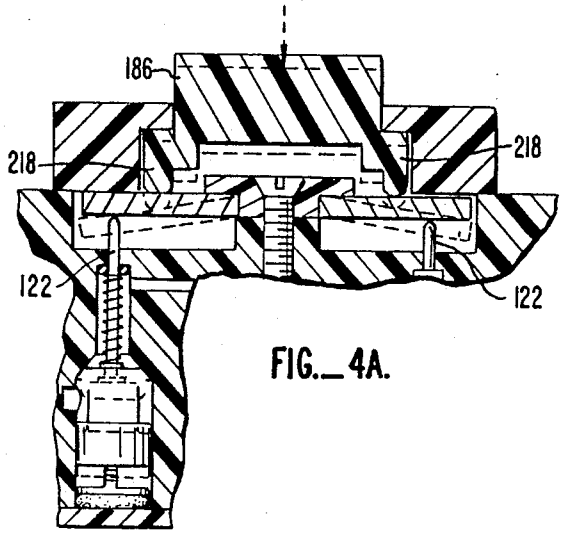

Base fluid buttons 182 are formed having two configurations, as shown by buttons **182*a* and 182*b*. Button 182*a* is formed as a generally cylindrical button with a shoulder 206 which is sized for covering its associated aperture 194 and for impeding the passage of stem 122 through aperture 194. Shoulder 206 also contacts butterfly plate 162. Therefore, when button 182*a* is depressed, both butterfly plate 162 and its associated valve plunger stem 110 are depressed, as shown in FIG. 4*b*. Simultaneously, the rigid surface disposed over the mixing fluid valve depresses that valve plunger stem as well. Button 182*b* is formed as a generally cylindrical button with a projection 202 at the bottom thereof. Projection 202 is sized for extending through a corresponding aperture 194 in butterfly plate 162 without contacting butterfly plate 162. Accordingly, each button 182*b* may depress stem 122, and therefore its associated valve plunger 110, without causing butterfly plate 162** to pivot.

Each of mixing fluid buttons 186 and 190 includes a generally rectangular or oval button section 210 having spaced apart projections 218. Each projection 218 contacts the rigid surface portion 198 of its associated butterfly plates 162 so that, when buttons 186 and 190 are depressed, they cause the butterfly plates 162 to pivot and depress the associated mixing fluid valve stems 122, as shown in FIG. **4*a*. Each base fluid valve stem passes through its associated opening in butterfly plate 162, so only mixing fluid flows through beverage dispensing head 126**. The use of two valve assemblies to control the flow of each mixing fluid allows a larger flow of mixing fluid to be dispensed with a single button. Of course, each mixing fluid may be dispensed with only one valve if the size of a particular beverage head is limited.

Thus, when it is desired to dispense only mixing fluid, one or both of buttons 186 and 190 may be depressed for activating only the valves associated with the mixing fluid. When a combination of base fluid and mixing fluid is desired, a button **182*a* is depressed for actuating both the base fluid and mixing fluid valves. Because the butterfly plate pushes down equally on both mixing fluid and base fluid valve stems in a straight line, both valves operate simultaneously. This substantially eliminates the possibility of one valve opening slightly ahead of or more than the other, which can cause inconsistent mixing fluid/base fluid proportions, and thereby affect the quality of the drink. Abutment 164 helps to prevent flexing of butterfly plates 162 by acting as a brace for the butterfly plate between the mixing fluid valve and the base fluid button 182*a* which is intended to activate it. Finally, when only base fluid is desired, a button 182*b*** is depressed for activating only the associated base fluid valve.

An important feature of the present invention is that, for a given butterfly plate 162, any button may be changed at any time from configuration **182*a* to 182*b* for allowing any base fluid to be dispensed alone or in combination with a mixing fluid. To determine which base fluids may be associated with which mixing fluids, a kit supplying a plurality of butterfly plate configurations may be provided, as shown in FIG. 5. Since a given base fluid typically is intended to be coupled with only one mixing fluid, those butterfly plate configurations which cover all the base fluid valve assemblies on a side of abutment 164 typically have an opening 214 or 218 disposed over the undesired mixing fluid valves. Thus, when the butterfly plate 162 pivots, it does not activate the undesired mixing fluid valve. On the other hand, openings 214 and 218 allow the projections 218 in the associated soda or water buttons 186, 190 to pass through the butterfly plates 162** so that the uncoupled mixing fluid may be dispensed independently by pressing its associated button.

Accordingly, by providing a kit having the plurality of butterfly valve configurations shown in FIG. 5, together with a plurality of buttons having the configurations shown for buttons **182*a* and 182*b***, a substantially unlimited number of base fluid/mixing fluid combinations may be effected, and any button may be changed at any time to provide for mixed or unmixed beverages without requiring a different butterfly plate.

Brixing Device

FIGS. 6 and 7 show the brixing device 18 according to the present invention. Brixing device 18 includes a tube collector housing 250 and an input module assembly 254. Tube collector housing 250 includes a sheath bracket 258 for receiving an end of sheath 92 which, in turn, terminates in a sheath bushing 262. Sheath bracket 258 maintains the end of sheath 92 in place within tube collector housing 250. Tube collector housing 250 also includes a tube collector cover 263, which is held in place on tube collector housing 250 through a plurality of cover screws 264.

Tube collector housing 250 can accommodate a number of tubes 68 in a number of different sizes. For example, tube collector housing 250 can accommodate a high-pressure tube **68*a*, a regular sized beverage tube 68*b*, or a large sized beverage tube 68*c*. Tubes 68*a*, 68*b*, and 68*c* are coupled to corresponding interconnect fittings 278 by tube lock rings 282. Each interconnect fitting 278 has an interconnect O-ring 286 fitted within an annular groove 290 located on its free end. Each interconnect fitting 278 is fitted within a cradle 294 so that its free end extends from a face 298 of tube collector housing 250. Also extending from face 298 of tube collector housing 250 are a pair of dowel pins 302 which are received within openings 306 located in input module assembly 254**.

Input module assembly 254 includes an input module frame 342 and a plurality of input modules 346. Each input module 346 is affixed to input module frame 342 by a brix screw 350 and a shutoff screw 354, as shown in FIG. 8. Brix screw 350 and shutoff screw 354 include portions 355 and 356, respectively, which extend into the passage 357 defined within input module 346. Brix screw 350 includes a cylindrical opening 358 in portion 355 so that the amount of fluid flowing through brixing device 18 may be regulated. Shutoff screw 354 allows fluid flow through the input module to be shut off completely and independently of brix screw 350. Each screw 350 and 354 includes a screw O-ring 362 which fits on annular grooves 365 for preventing external leakage.

Figure 9A:
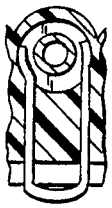
Figure 9B:
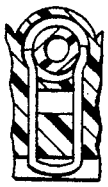

Each input module 346 has an end 366 which is sized for receiving the free end of a corresponding interconnect fitting 278 therein. Similarly, the opposite end 370 of each input module 364 has an opening 374 sized for receiving an end of an input fitting 378 therein. Each input fitting 378 has an annular groove 382 into which is fitted an input fitting O-ring 386 for preventing external leakage. Each end 366 and 370 has pairs of openings 390, 392, respectively, which align with corresponding openings 396 and 398 in input module frame 342 when input module 346 is affixed thereto. Openings 390 and 396 align with an annular recess 402 disposed on the free end of its associated interconnect fitting 278 when input module 346 is matingly engaged with interconnect fitting 278. For maintaining interconnect fitting 278 matingly engaged with its corresponding input module 346, portions 404 of a fastening clip 406 are projected through openings 396 and 390 and into recess 402 of interconnect fitting 278, as shown in FIGS. 8 and 9*b*. Similarly, openings 392 and 398 align directly in front of a face 416 of input fitting 378. For maintaining input fitting 378 matingly engaged with its corresponding input module 346, portions 410 of a fastening clip 412 are projected through openings 398 and 392 and disposed in front of a face 416 of input fitting 378, as shown in FIG. 8 and 9*a*.

Disposed within each opening 306 of input module frame 342 are an ejector pin 422, an ejector spring 426, and an ejector set screw 430. When tube collector housing 250 is coupled to input module frame 342 and dowel pins 302 are received within openings 306, each spring 426 biases its associated dowel pin 302, and therefore tube collector housing 250, away from input module assembly 254. This helps to decouple tube collector housing 250 from input module frame 342.

To further help decouple tube collector housing 250 from input module assembly 254, a cam 450 is affixed to tube collector housing 250 through a cam pivot pin 454. Cam 450 includes a cam knob 458 attached to a cam lever portion 462 of cam 450 by a cam knob screw 466. Cam knob 458 is located on the exterior of tube collector housing 250, and is slidingly received within a channel 470 for pivoting cam 450 about cam pivot pin 454. As shown in FIG. 7, cam 450 may be pivoted from a first position, wherein a lobe 474 of cam 450 is in a retracted position within tube collector housing 250, to a second position (shown in phantom) wherein lobe 474 extends from surface 298 of tube collector housing 250. Therefore, when cam lobe 474 is pivoted, it abuts against a face 480 of input module assembly 254 for decoupling input module assembly 254 from tube collector housing 250.

From the foregoing, it is apparent that tube collector housing 250 may be decoupled from input module assembly 254, and input module assembly 254 decoupled from the pressurized beverage source, without the use of tools. This innovation expedites service in a bar environment. In order to decouple tube collector housing from input module assembly 254, each fastening clip 406 is pulled out from its associated input module/interconnect fitting pair, and cam 450 is pivotated to assist the two spring-loaded ejector pins 422 in breaking the two assemblies away from each other. Similarly, in order to decouple an input fitting 378 from its associated input module 346, the associated fastening clip 412 is pulled out from the input module and the components are separated. The removable input modules 364 allow individual base and mixing fluids to be added to or deleted from a dispenser without purchasing a separate brixing device or an entire dispensing apparatus.

While the above is a complete description of a preferred embodiment of the present invention, various modifications may be employed. Consequently, the scope of the invention should not be limited except as properly described in the claims.

I claim:

1. In a beverage dispensing head of the type for use with pressurized sources of base and mixing fluids coupled to the head by a plurality of fluid conduits, the head including a plurality of fluid passageways connecting the fluid conduits to a discharge nozzle with associated base and mixing fluid valves controlling the flow of fluid along the passageways, the base and mixing fluid valves including base and mixing fluid valve stems which move between valve closed and valve open positions for selectively closing and opening the base and mixing fluid valves, the base and mixing fluid valve stems being biased in the valve closed position, the improvement comprising:

a plate disposed over a base fluid valve stem and a mixing fluid valve stem, the plate having an opening located over the base fluid valve stem capable of receiving the base fluid valve stem therethrough, and the plate having a rigid surface disposed over the mixing fluid valve stem; and first plate moving means for moving the plate toward the base and mixing fluid valve stems so that the rigid surface of the plate causes the mixing fluid valve stem to be in the valve open position, and so that the base fluid valve stem passes through the opening in the plate for maintaining the base fluid valve stem in the valve closed position; and second plate moving means for moving the plate toward the base and mixing fluid valve stems, the second plate moving means including base fluid valve stem impeding means for impeding the passage of the base fluid valve stem through the opening in the plate, so that the rigid surface of the plate causes the mixing fluid valve stem to be in the valve open position, and so that the base fluid valve stem impeding means impedes the passage of the base fluid valve stem through the opening in the plate and causes the base fluid valve stem to be in the valve open position.

2. The beverage dispensing head according to claim further comprises base fluid valve stem moving means for passing through the opening in the plate and for selectively causing the base fluid valve stem to be in the valve open position independently of the position of the mixing fluid valve stem.

3. The apparatus according to claim 1 wherein the first plate moving means comprises a first button having a surface which contacts the plate for pressing the plate toward the base and mixing fluid valve stems.

4. The apparatus according to claim 3 wherein the surface of the first button is located away from the opening in the plate.

5. The apparatus according to claim 4 wherein the second plate moving means comprises a second button having a surface which contacts the plate and substantially covers the opening in the plate.

6. An apparatus for dispensing a beverage of the type for use with pressurized sources of base and mixing fluids comprising:

a first housing having first and second openings;

a base fluid valve stem and a mixing fluid valve stem, each base fluid valve stem and mixing fluid valve stem having a valve seat surface;

the first and second openings defining base and mixing fluid valve stem bores for reciprocally housing the base and mixing fluid valve stem therein for movement between valve open and valve closed positions;

valve seats positioned along the valve stem bores against which the valve seat surfaces press when the respective base and mixing fluid valve stems are in valve closed positions to close the valve stem bores;

the base and mixing fluid valve stem bores including base and mixing fluid entry and exit chambers, the entry chambers being positioned on one side of the valve seats, and the exit chambers being positioned on the other side of the valve seats;

means for fluidly coupling the base and mixing fluid exit chambers to a discharge opening;

means for biasing the base and mixing fluid valve stems toward the valve closed positions;

a plate disposed over the base and mixing fluid valve stems, the plate having an opening located over the base fluid valve stem capable of receiving the base fluid valve stem therethrough, and the plate having a rigid surface disposed over the mixing fluid valve stem; and first plate moving means for moving the plate toward the base and mixing fluid valve stems, so that the rigid surface of the plate causes the mixing fluid valve stem to be in the valve open position, and so that the base fluid valve stem passes through the opening in the plate for maintaining the base fluid valve stem in the valve closed position; and second plate moving means for moving the plate toward the base and mixing fluid valve stems, the second plate moving means including base fluid valve stem impeding means for impeding the passage of the base fluid valve stem through the opening in the plate, so that the rigid surface of the plate causes the mixing fluid valve stem to be in the valve open position, and so that the base fluid valve stem impeding means impedes the passage of the base fluid valve stem through the opening in the plate and causes the base fluid valve stem to be in the valve open position.

7. The beverage dispensing head according to claim 6 further comprising base fluid valve stem moving means for extending through the opening in the plate and for causing the base fluid valve stem to be in the valve open position independently of the mixing fluid valve stem.

8. The apparatus according to claim 6 wherein the first plate moving means comprises a first button having a surface which contacts the plate for pressing the plate toward the base and mixing fluid valve stems when the first button is depressed.

9. The apparatus according to claim 8 wherein the surface of the first button is located away from the opening in the plate.

10. The apparatus according to claim 9 wherein the second plate moving means comprises a second button having a surface which contacts the plate and substantially covers the opening in the plate, for pressing the plate toward the base and mixing fluid valve stems when the second button is depressed.

11. The apparatus according to claim 10 wherein the first housing further comprises an abutment extending along one side of the valve stem bores.

12. The apparatus according to claim 11 wherein the plate includes a small projection on one side thereof, the projection contacting the abutment so that the plate pivots relative to the abutment when either one of the first or second buttons is depressed.

13. The apparatus according to claim 12 further comprising source coupling means for fluidly coupling the base and mixing fluid entry chambers to the base and mixing fluid sources.

14. The apparatus according to claim 13 wherein the source coupling means further comprises:

a second housing including a base fluid tube and a mixing fluid tube;

a third housing including a base fluid tube and a mixing fluid tube:

fluid coupling means for fluidly coupling first ends of the base and mixing fluid tubes of the second housing to the respective base and mixing fluid entry chambers, and for fluidly coupling first ends of the base and mixing fluid tubes of the third housing to the respective base and mixing fluid sources; and housing coupling means for fluidly coupling second ends of the base and mixing fluid tubes of the second housing to second ends of the respective base and mixing fluid tubes of the third housing.

15. The apparatus according to claim 14 wherein the second ends of the base and mixing fluid tubes of the second housing extend therefrom and are sized to be slidingly received within the respective second ends of the base and mixing fluid tubes of the third housing, and wherein the housing coupling means further comprises mating means for matingly engaging the second ends of the base and mixing fluid tubes of the second housing with the respective second ends of the base and mixing fluid tubes of the third housing.

16. The apparatus according to claim 15 wherein the second ends of the base and mixing fluid tubes of the second housing each have a recess on a side thereof, and wherein the second ends of the base and mixing fluid tubes of the third housing each have an opening on the side thereof which aligns with the recess in the respective base and mixing fluid tubes of the second housing when the base and mixing fluid tubes of the second and third housing are matingly engaged, and wherein the mating means further comprises a clip having a portion which extends through at least one of the openings in the second ends of the base and mixing fluid tubes in the third housing and into the respective recess in the associated base or mixing fluid tube in the second housing.

17. The apparatus according to claim 16 wherein the source coupling means further comprises decoupling means for decoupling the second and third housing from each other.

18. The apparatus according to claim 17 wherein the decoupling means further comprises a cam pivotably disposed in a selected one of the second or third housings, the cam having a lobe which gradually extends from the selected second or third housing when the cam is pivoted.

19. The apparatus according to claim 18 wherein the lobe presses against the other second or third housing when the cam is pivoted for pressing the second and third housings away from each other.

20. The apparatus according to claim 19 wherein a selected one of the second or third housings has an opening on the surface which abuts the other second or third housing when the second and third housings are coupled, and wherein the decoupling means further comprises:

a dowel pin extending from the other second or third housing, the dowel pin being received by the opening in the selected second or third housing when the second and third housings are coupled: and a spring disposed in the opening of the selected second or third housing for biasing the dowel pin and therefore the other second or third housing away from the selected second or third housing when the second and third housings are coupled.

21. The apparatus according to claim 20 wherein the fluid coupling means includes means for removably attaching the base and mixing fluid tubes of the third housing to the third housing.

22. The apparatus according to claim 21 wherein the first end of each base and mixing fluid tube of the third housing has an opening on a side thereof and further comprising:

an input fitting for each base and mixing fluid tube of the third housing, each input fitting being sized to fit within the first end of its associated base or mixing fluid tube, each input fitting having a face which aligns with the opening on the side of the first end of its associated base or mixing fluid tube when the input fitting is fitted therein; and a second clip for each input fitting, the second clip having a portion which extends through the opening in the first end of its associated base or mixing fluid tube of the third housing and in front of the face of its associated input fitting for affixing the input fitting to its associated base or mixing fluid tube.

23. In a beverage dispensing head of the type for use with pressurized sources of mixing fluid and a plurality of base fluids, the pressurized sources being fluidly coupled to the head by fluid conduits, the head including a plurality of fluid passageways connecting the fluid conduits to a discharge nozzle, the head including a mixing fluid valve and plurality of base fluid valves for controlling the flow of fluid along the passageways, the mixing fluid valve and plurality of base fluid valves including mixing fluid and base fluid valve stems which move between valve closed and valve open positions for selectively closing and opening the mixing fluid and base fluid valves, a kit for coupling the operation of the mixing fluid valves to selected ones of the plurality of base fluid valves comprising:

a plurality of rigid plates for being disposed over the mixing fluid valve stem and selected ones of the plurality of base fluid valve stems, the selected base fluid valve stems associated with one plate being different from the selected base fluid valve stems associated with another plate, each plate having an opening located over each base fluid valve stem capable of passing its associated base fluid valve stem therethrough, and each plate having a rigid surface disposed over the mixing fluid valve stem.

24. The kit according to claim 23 further comprising a first button for contacting the plate for moving the plate toward the mixing fluid valve stem and the plurality of base fluid valve stems when the first button is depressed so that the surface of the plate causes the mixing fluid valve stem to be in the valve open position, and so that the plurality of base fluid valve stems pass through their associated openings in the plate for maintaining the plurality of base fluid valve stems in the valve closed position.

25. The kit according to claim 24 further comprising a second button having a surface for contacting the plate and substantially covering an opening in the plate, so that, when the second button is depressed:

the rigid surface of the plate causes the mixing fluid valve stem to be in the valve open position; and the surface of the second button impedes the passage of the associated base fluid valve stem through the opening in the plate and causes the base fluid valve stem to be in the valve open position.

26. The kit according to claim 25 further comprising a third button having a stem for passing through a selected opening in the plate and contacting the associated base fluid valve stem, so that, when the third button is depressed, the associated base fluid stem is caused to be in the valve open position independently of the position of the mixing fluid valve stem.

27. In a beverage dispensing head of the type for use with pressurized sources of base and mixing fluids coupled to the head by a plurality of fluid conduits, the head including a plurality of fluid passageways connecting the fluid conduits to a discharge nozzle with associated mixing fluid and plurality of base fluid valves controlling the flow of fluid along the passageways, the mixing fluid and plurality of base fluid valves including mixing fluid and base fluid valve stems which move between valve closed and valve open positions for selectively closing and opening the mixing fluid and plurality of base fluid valves, the base and mixing fluid valve stems being biased in the valve closed position, a kit for coupling the operation of the mixing fluid valve to selected ones of the plurality of base fluid valves comprising:

a plurality of rigid plates for being disposed over the mixing fluid valve stem and selected ones of the plurality of base fluid valve stems, the selected base fluid valve stems for one plate being different from the selected base fluid valve stems for another plate, each plate having an opening located over each base fluid valve stem capable of passing its associated base fluid valve stem therethrough and each plate having a rigid surface disposed over the mixing fluid valve stem;

first plate moving means for moving a selected plate toward its associated mixing fluid and plurality of base fluid valve stems so that the rigid surface of the plate causes the mixing fluid valve stem to be in the valve open position, and so that the selected base fluid valve stems pass through their associated openings in the plate for maintaining the plurality of base fluid valve stems in the valve closed position; and second plate moving means for moving the selected plate toward the mixing fluid and selected base fluid valve stems, the second plate moving means including base fluid valve stem impeding means for impeding the passage of a base fluid valve stem through its associated opening in the plate, so that the first surface of the plate causes the mixing fluid valve stem to be in the valve open position, and so that the base fluid valve stem impeding means impedes the passage of the base fluid valve stem through its associated opening in the plate and causes the base fluid valve stem to be in the valve open position.

28. The beverage dispensing head according to claim 27 further comprising base fluid valve stem moving means for extending through an opening in the plate and for causing the base fluid valve stem associated with the opening to be in the valve open position independently of the mixing fluid valve stem.

29. The apparatus according to claim 28 wherein the first plate moving means comprises a first button having a surface which contacts the plate for pressing the plate toward the base and mixing fluid valve stems when the first button is depressed.

30. The apparatus according to claim 29 wherein the surface of the first button is located away from the plurality of openings in the plate.

31. The apparatus according to claim 30 wherein the second plate moving means comprises a second button having a surface which contacts the plate and substantially covers the opening in the plate, for pressing the plate toward the base and mixing fluid valve stems when the second button is depressed.

32. The apparatus according to claim 31 wherein the mixing fluid and plurality of base fluid valve stems are located in a row, wherein the head includes an abutment disposed adjacent to the mixing fluid and plurality of base fluid valve stems; and wherein each plate includes a small projection on one side thereof, the projection contacting the abutment so that the plate pivots relative to the abutment when either one of the first or second buttons is depressed.

* * * * *